US012618119B2

(12) United States Patent
Yang et al.

(10) Patent No.: US 12,618,119 B2
(45) Date of Patent: May 5, 2026

(54) HYDROGEN-RICH BLAST FURNACE IRONMAKING SYSTEM BASED ON MASS-ENERGY CONVERSION, AND PRODUCTION CONTROL METHOD THEREFOR

(71) Applicants: CHANGLI COUNTY XINGGUO PRECISION MACHINE PARTS CO., LTD., Qinhuangdao (CN); Shanghai University, Shanghai (CN)

(72) Inventors: Yuzhu Yang, Qinhuandao (CN); Xionggang Lu, Shanghai (CN); Wenhe Wu, Shanghai (CN); Yuwen Zhang, Shanghai (CN); Kai Zhu, Shanghai (CN); Guocheng Zhou, Qinhuandao (CN); Jian Li, Qinhuandao (CN)

(73) Assignees: CHANGLI COUNTY XINGGUO PRECISION MACHINE PARTS CO., LTD., Qinhuangdao (CN); Shanghai University, Shanghai (CN)

( * ) Notice: Subject to any disclaimer, the term of this patent is extended or adjusted under 35 U.S.C. 154(b) by 0 days.

(21) Appl. No.: 19/104,476

(22) PCT Filed: Aug. 1, 2023

(86) PCT No.: PCT/CN2023/110622
§ 371 (c)(1),
(2) Date: Feb. 18, 2025

(87) PCT Pub. No.: WO2024/037337
PCT Pub. Date: Feb. 22, 2024

(65) Prior Publication Data

US 2025/0257415 A1 Aug. 14, 2025

(30) Foreign Application Priority Data

Aug. 18, 2022 (CN) ..... 202210989945.5

(51) Int. Cl.
*C21B 5/00* (2006.01)
*C25B 1/04* (2021.01)
*C25B 15/08* (2006.01)

(52) U.S. Cl.
CPC ..... *C21B 5/001* (2013.01); *C21B 5/006* (2013.01); *C25B 1/04* (2013.01); *C25B 15/081* (2021.01); *C21B 2005/005* (2013.01)

(58) Field of Classification Search
CPC ... C21B 5/001; C21B 5/006; C21B 2005/005; C25B 1/04; C25B 15/081
See application file for complete search history.

(56) References Cited

U.S. PATENT DOCUMENTS 5,234,490 A * 8/1993 Kundrat ..... C21B 5/06 75/464
2020/0149124 A1* 5/2020 Blostein ..... F27D 7/02

FOREIGN PATENT DOCUMENTS

CN 102424873 A 4/2012
CN 102424873 B * 1/2013
(Continued)

OTHER PUBLICATIONS

CN-112899427-A Trans (English Lanugage Translation) (Year: 2021).*
(Continued)

*Primary Examiner* — Keith D. Hendricks
*Assistant Examiner* — Moriah S. Smoot
(74) *Attorney, Agent, or Firm* — Ziegler IP Law Group, LLC.

(57) ABSTRACT

A hydrogen-rich blast furnace ironmaking system based on mass-energy conversion, comprising a water electrolysis system (2). The water electrolysis system (2) is separately connected to a hydrogen storage tank (3) and an oxygen storage tank (4); a gas outlet of the hydrogen storage tank (3)
(Continued)

is connected to a hydrogen compressor (5); an outlet of the hydrogen compressor (5) is connected to a hydrogen buffer tank (6); the hydrogen buffer tank (6) is connected to a hydrogen injection valve group (7); the hydrogen injection valve group (7) is connected to a hydrogen preheating system (8); and the hydrogen preheating system (8) is connected to a tuyere of a blast furnace body (1) or a hydrogen injector at the lower portion of the furnace body.

3 Claims, 1 Drawing Sheet

(56) References Cited

FOREIGN PATENT DOCUMENTS

| | | | | | |
|---|---|---|---|---|---|
| CN | 105886688 | A | | 8/2016 | |
| CN | 207877654 | U | * | 9/2018 | |
| CN | 112899427 | A | * | 6/2021 | ..... C21B 13/02 |
| CN | 114438270 | A | | 5/2022 | |
| CN | 114525518 | A | * | 5/2022 | ..... C25B 1/04 |
| CN | 115522003 | A | | 12/2022 | |
| JP | 2012052162 | A | | 3/2012 | |
| JP | 2024522088 | A | | 6/2024 | |
| JP | 2025502666 | A | | 1/2025 | |
| WO | 2021106579 | A1 | | 6/2021 | |
| WO | 2022253938 | A1 | | 12/2022 | |
| WO | 2023111654 | A1 | | 6/2023 | |

OTHER PUBLICATIONS

CN-102424873-B Trans (English Lanugage Translation) (Year: 2013).*

CN-114525518-A Trans (English Lanugage Translation) (Year: 2022).*

CN 207877654 U Trans (English Language Translation) (Year: 2018).*

China National Intellectual Property Administration, International Search Report, Application No. PCT/CN2023/110622, mailed Oct. 25, 2023, 6 pages.

China, The State Intellectual Property Office, Notice of opinion for the first review, Application No. 202210989945.5, mailed Feb. 24, 2023, 16 pages.

* cited by examiner

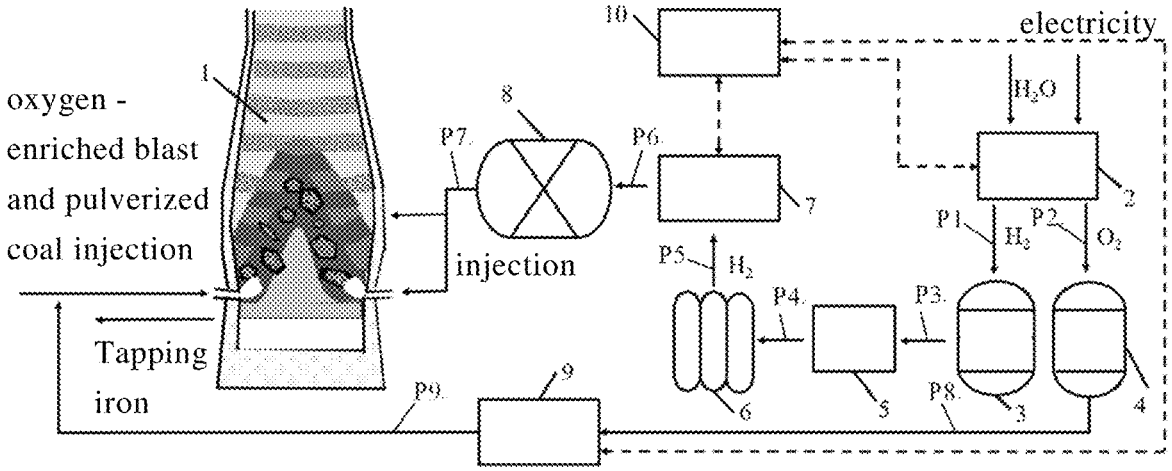
oxygen -
enriched blast
and pulverized
coal injection
Tapping
iron
1
8
P7
P6
injection
10
7
electricity
$H_2O$
2
P1
$H_2$
P2
$O_2$
P5
$H_2$
P4
P3
6
5
3
4
P8
P9
9

HYDROGEN-RICH BLAST FURNACE IRONMAKING SYSTEM BASED ON MASS-ENERGY CONVERSION, AND PRODUCTION CONTROL METHOD THEREFOR

FIELD OF THE INVENTION

The present invention relates to the field of hydrogen-rich and low-carbon smelting in blast furnaces during the iron and steel metallurgy process, and particularly to a hydrogen-rich blast furnace ironmaking system based on energy-mass conversion and its production control method.

DESCRIPTION OF THE PRIOR ART

Coke and pulverized coal are important sources of heat and reducing agents in the blast furnace ironmaking process. Currently, the average coke ratio per ton of iron in the national ironmaking process is 355.48 kg, and the coal ratio is greater than 150 kg. However, the current global inflation pressure continues to rise, and fluctuations in the domestic and international commodity markets have intensified. In particular, the prices of blast furnace smelting raw materials such as coking coal and coke have increased significantly, which has a great impact on the production cost of the blast furnace ironmaking process. As a result, the operational difficulty of steel enterprises has further increased. At the same time, as the country has made strategic decisions in response to climate change and deployed the strategic goals of "carbon neutrality and carbon peak", the steel industry is on the one hand faced with the constraints of the energy assessment target of "dual-control of energy consumption". At the same time, with the continuous improvement of the national carbon emission trading rules and market, steel enterprises will soon be included in the carbon emission trading market. Enterprises with high carbon emissions per unit of product will face higher costs of carbon and energy use.

China is the world's largest country in the photovoltaic (PV) and wind power manufacturing industries. In recent years, the policies for the PV and wind power industries have been continuously improved, their scales have been expanding, and technologies have been advancing. This has led to a continuous decline in the cost of new energy power generation. In some regions, the cost is even lower than that of traditional energy power generation. However, due to the prominent structural contradiction between the supply side of new energy power generation and the electricity demand side, the problem of "wind and power curtailment" is severe. During the periods when new energy power generation is concentrated, the peak-shaving capacity of some local thermal power units is insufficient, which affects the safe operation of the power grid. On the other hand, this also causes the price difference between peak- and off-peak electricity to widen further.

As a clean energy source, hydrogen, through the hydrogen-rich smelting technology in blast furnaces, can replace part of the carbon-based raw materials used in blast furnace smelting. This effectively reduces the carbon emissions in the ironmaking process, significantly improves the effective utilization coefficient of the blast furnace, and achieves remarkable energy-saving and carbon-reduction effects. It is of great significance to promote the transformation and upgrading of the steel industry to figure out how to use clean new-energy electricity or low-cost off-peak electricity to complete energy-mass conversion, supply non-carbon-based reducing agents and heat sources to the blast furnace. Meanwhile, by combining corresponding production control processes, optimizing the control of hydrogen production power and hydrogen injection volume, a high-efficiency and low-cost ironmaking method can be realized, thus improving the ecological and production-operation efficiency issues brought about by the coal-dominated energy structure.

Therefore, technicians in this field are committed to developing a hydrogen injection process that can maximize the economic benefits in blast furnace production.

SUMMARY OF THE INVENTION

In view of the above-mentioned defects in the prior art, the technical problem to be solved by the present invention is how to maximize the economic benefits of blast-furnace hydrogen injection.

To achieve the above-mentioned objective, the present invention first provides a hydrogen-rich blast furnace ironmaking system based on energy-mass conversion, characterized by comprising an electrolyzed water system, which is respectively connected to a hydrogen gas storage tank and an oxygen gas storage tank; the gas outlet of the hydrogen gas storage tank is connected to a hydrogen compressor; the outlet of the hydrogen compressor is connected to a hydrogen buffer tank; the hydrogen buffer tank is connected to a hydrogen injection valve group; the hydrogen injection valve group is connected to a hydrogen pre-heating system; and the hydrogen pre-heating system is connected to the tuyere of the blast furnace body or the hydrogen injection device at the lower part of the furnace shaft.

Further, the gas outlet of the oxygen gas storage tank is connected to an oxygen injection valve group, and the oxygen injection valve group is connected to the cold air main pipe of the blast furnace body.

Further, the hydrogen-rich blast furnace ironmaking system comprises a hydrogen injection quantity calculation and control system. The control signals of the hydrogen injection quantity calculation and control system are connected to the electrolyzed water system, the hydrogen injection valve group and the oxygen injection valve group through signal transmission lines. And the hydrogen production power of the electrolyzed water system and the hydrogen injection quantity into the blast furnace are synchronously controlled and adjusted through the control signals to obtain the hydrogen injection quantity that maximizes the current benefit per ton of iron.

Further, the hydrogen injection quantity calculation and control system determines the hydrogen injection quantity that maximizes the current benefit per ton of iron through the calculation formula for the economic benefit of hydrogen injection. The calculation formula for the economic benefit of hydrogen injection is as follows:

$$B = \frac{M_0 - M}{1000} \times P_M + \frac{K_0 - K}{1000} \times P_K + \frac{\eta V_{BF} - \eta_0 V_{BF}}{\eta V_{BF}} \times P_{PI} + (C_0 - C) \times P_{CO_2} + (E_0 - E) - H \times P_{H_2};$$

In the formula:

B: The benefit per ton of iron after hydrogen injection into the blast furnace under the current market conditions, with the unit of yuan per ton of iron (yuan/t);

$M_0$: The coal ratio without hydrogen injection, with the unit of kilograms per ton of iron (kg/t);

M: The coal ratio with hydrogen injection, with the unit of kilograms per ton of iron (kg/t);

$P_m$: The price of the injected pulverized coal, with the unit of yuan per ton of iron (yuan/t);

$K_0$: The coke ratio without hydrogen injection, with the unit of kilograms per ton of iron (kg/t);

K: The coke ratio with hydrogen injection, with the unit of kilograms per ton of iron (kg/t);

$P_k$: The price of the charged coke, with the unit of yuan per ton of iron (yuan/t);

$\eta_0$: The utilization coefficient of the blast furnace without hydrogen injection, with the unit of tons per cubic meter per day [t/(m$^3$·d)];

$\eta$: The utilization coefficient of the blast furnace with hydrogen injection, with the unit of tons per cubic meter per day [t/(m$^3$·d)];

VBF: The effective volume of the blast furnace, with the unit of cubic meters (m$^3$);

PPI: The profit per ton of iron, with the unit of yuan per ton (yuan/t);

$C_0$: The direct $CO_2$ emission without hydrogen injection, with the unit of tons per ton of iron (t/t);

C: The direct $CO_2$ emission with hydrogen injection, with the unit of tons per ton of iron (t/t);

$PCO_2$: The carbon-emission trading price, with the unit of yuan per ton of iron (yuan/t);

$E_0$: The operating cost of environmental protection facilities per ton of iron without hydrogen injection, with the unit of yuan per ton of iron (yuan/t);

E: The operating cost of environmental protection facilities per ton of iron with hydrogen injection, with the unit of yuan per ton of iron (yuan/t);

$P_{h^2}$: The production price of hydrogen, with the unit of yuan per standard cubic meter (yuan/Nm$^3$);

H: The hydrogen injection volume, with the unit of standard cubic meters per ton of iron (Nm$^3$/t).

Further, the electrolyzed water system is arranged to be powered by the electricity generated by photovoltaic solar panels, off-peak electricity from the power grid or wind energy.

In addition, the present invention also provides a production control method for a hydrogen-rich blast furnace ironmaking system based on energy-mass conversion, characterized by comprising the following steps:

(1) Providing a hydrogen-rich blast furnace ironmaking system based on energy-mass conversion, which including an electrolyzed water system. The electrolyzed water system being respectively connected to a hydrogen gas storage tank and an oxygen gas storage tank. The gas outlet of the hydrogen gas storage tank being connected to a hydrogen compressor; the outlet of the hydrogen compressor being connected to a hydrogen buffer tank; the hydrogen buffer tank being connected to a hydrogen injection valve group; the hydrogen injection valve group being connected to a hydrogen pre-heating system; the hydrogen pre-heating system being connected to the tuyere of the blast furnace body or the hydrogen injection device at the lower part of the furnace shaft. The gas outlet of the oxygen gas storage tank being connected to an oxygen injection valve group, and the oxygen injection valve group being connected to the cold air main pipe of the blast furnace body. The system also including a hydrogen injection quantity calculation and control system, and the control signals of the hydrogen injection quantity calculation and control system being connected to the electrolyzed water system, the hydrogen injection valve group and the oxygen injection valve group through signal transmission lines.

(2) Starting the electrolyzed water system. The electrolyzed water system transporting the hydrogen and oxygen obtained after electrolysis to the hydrogen gas storage tank and the oxygen gas storage tank respectively. The hydrogen in the hydrogen gas storage tank being pressurized by the hydrogen compressor and then entering the hydrogen buffer tank. Then, after the pressure and flow being adjusted by the hydrogen injection valve group, the hydrogen being pre-heated in the hydrogen pre-heating system. The pre-heated hydrogen being injected into the blast furnace through the hydrogen injection device.

Further, the production control method comprises the step of: after the pressure and flow rate of the oxygen in the oxygen storage tank being adjusted by the oxygen injection valve group, the oxygen being injected into the blast furnace through the cold air main pipe.

Further, the production control method comprises the step of: after the hydrogen injection quantity calculation and control system determining the hydrogen injection quantity that maximizing the current benefit per ton of iron through the calculation formula for the economic benefit of hydrogen injection, synchronously controlling and adjusting the hydrogen production power of the electrolyzed water system and the hydrogen injection quantity into the blast furnace through control signals. The calculation formula for the economic benefit of hydrogen injection is as follows:

$$B = \frac{M_0 - M}{1000} \times P_M + \frac{K_0 - K}{1000} \times P_K + \frac{\eta V_{BF} - \eta_0 V_{BF}}{\eta V_{BF}} \times P_{PI} + (C_0 - C) \times P_{CO_2} + (E_0 - E) - H \times P_{H_2};$$

In the formula:

B: The benefit per ton of iron after hydrogen injection into the blast furnace under the current market conditions, with the unit of yuan per ton of iron (yuan/t);

$M_0$: The coal ratio without hydrogen injection, with the unit of kilograms per ton of iron (kg/t);

M: The coal ratio with hydrogen injection, with the unit of kilograms per ton of iron (kg/t);

$P_m$: The price of the injected pulverized coal, with the unit of yuan per ton of iron (yuan/t);

$K_0$: The coke ratio without hydrogen injection, with the unit of kilograms per ton of iron (kg/t);

K: The coke ratio with hydrogen injection, with the unit of kilograms per ton of iron (kg/t);

$P_k$: The price of the charged coke, with the unit of yuan per ton of iron (yuan/t);

$\eta_0$: The utilization coefficient of the blast furnace without hydrogen injection, with the unit of tons per cubic meter per day [t/(m$^3$·d)];

$\eta$: The utilization coefficient of the blast furnace with hydrogen injection, with the unit of tons per cubic meter per day [t/(m$^3$·d)];

VBF: The effective volume of the blast furnace, with the unit of cubic meters (m$^3$);

PPI: The profit per ton of iron, with the unit of yuan per ton (yuan/t);

$C_0$: The direct $CO_2$ emission without hydrogen injection, with the unit of tons per ton of iron (t/t);

C: The direct $CO_2$ emission with hydrogen injection, with the unit of tons per ton of iron (t/t);

$PCO_2$: The carbon-emission trading price, with the unit of yuan per ton of iron (yuan/t);

$E_0$: The operating cost of environmental protection facilities per ton of iron without hydrogen injection, with the unit of yuan per ton of iron (yuan/t);

E: The operating cost of environmental protection facilities per ton of iron with hydrogen injection, with the unit of yuan per ton of iron (yuan/t);

$P_{h^2}$: The production price of hydrogen, with the unit of yuan per standard cubic meter (yuan/$Nm^3$);

H: The hydrogen injection volume, with the unit of standard cubic meters per ton of iron ($Nm^3$/t).

Further, the electrolyzed water system is powered by the electricity generated by photovoltaic solar panels, off-peak electricity from the power grid, or wind energy.

Further, the fluctuating prices of raw materials and fuels, hydrogen price, carbon emission tax, and product price are obtained in real-time via a computer network and input into the hydrogen injection quantity calculation model of the hydrogen injection quantity calculation and control system.

In the method of the present invention, the water-electrolysis hydrogen-production system is built near the ironmaking blast furnace. The distributed hydrogen source layout eliminates the long-distance and large-scale transportation of hydrogen, greatly reducing the cost of hydrogen use, improving the safety of hydrogen use, and solving the problems of green power energy storage and effective consumption. The hydrogen produced by water electrolysis is directly used in hydrogen metallurgy, which can effectively reduce the carbon emissions in the ironmaking process, significantly improve the effective utilization coefficient of the blast furnace, and achieve remarkable energy-saving and carbon-reduction effects. Based on the real-time changes in the production raw materials, electricity costs, and product selling prices, the hydrogen-production power of the water-electrolysis hydrogen-production system and the hydrogen-injection quantity into the blast furnace are adjusted in real-time through the production control method, realizing high-efficiency and low-cost hydrogen-rich blast furnace ironmaking.

The present invention will establish a new process of large-scale economic hydrogen production-hydrogen storage-hydrogen-rich and low-carbon smelting in blast furnaces, promote the industrial application of hydrogen-rich and low-carbon ironmaking technology in blast furnaces, large-scale electrical energy storage for peak shaving and effective consumption technology. It can achieve significant low-carbonization in blast furnace ironmaking, laying a theoretical and technological foundation for the steel industry to further significantly reduce $CO_2$ emissions and achieve green manufacturing. This will contribute to the realization of the strategic goals of "carbon peak and carbon neutrality" and promote the establishment of a sustainable low-carbon economic society.

The following will further explain the concept, specific structure and technical effects of the present invention in combination with the accompanying drawings, so as to fully understand the purpose, characteristics and effects of the present invention.

BRIEF DESCRIPTION OF THE DRAWINGS

FIG. 1 is a schematic diagram of a hydrogen injection system for a hydrogen-rich blast furnace in a preferred embodiment of the present invention.

Reference numerals: 1—Blast furnace body; 2—Water-electrolysis hydrogen-production system; 3—Hydrogen gas storage tank; 4—Oxygen gas storage tank; 5—Hydrogen compressor; 6—Hydrogen buffer tank; 7—Hydrogen injection valve group; 8—Hydrogen pre-heating system; 9—Oxygen injection valve group; 10—Economic hydrogen-injection quantity calculation and control system.

DETAILED DESCRIPTION OF THE EMBODIMENTS

A plurality of preferred embodiments of the present invention are described below with reference to the drawings, which makes its technical content more clear and convenient to understand. The present invention may be embodied in many different forms of embodiments, and the scope of protection of the present invention is not limited to the embodiments set forth herein.

As shown in FIG. 1, in this embodiment, the hydrogen-injection system for a hydrogen-rich blast furnace and its production control method according to the present invention are applied to a blast furnace with an effective volume of 1780 $m^3$, including a 1780-$m^3$ blast furnace body, an electrolyzed water system with a hydrogen-production capacity of 35000 $m^3$/h, a 50-$m^3$ hydrogen gas storage tank, an oxygen gas storage tank, a hydrogen compressor, a 50-$m^3$ hydrogen buffer tank with a pressure resistance of 20 MPa, a hydrogen injection valve group, a hydrogen pre-heating system capable of heating up to 1000° C., an oxygen injection valve group, and an economic hydrogen-injection quantity calculation and control system.

The hydrogen ($H_2$) produced by the electrolyzed water system 2 is transported through pipeline P1 to the hydrogen gas storage tank 3, and the produced oxygen is transported through pipeline P2 to the oxygen gas storage tank 4. The gas outlet of the hydrogen gas storage tank 3 is connected via pipeline P3 to the low-pressure interface of the hydrogen compressor 5. After pressurization, the hydrogen exits from the high-pressure interface of the hydrogen compressor 5 and is connected through pipeline P4 to the inlet of the hydrogen buffer tank 6. The outlet of the hydrogen buffer tank 6 is connected via pipeline P5 to the hydrogen injection valve group 7. After the pressure and flow of the hydrogen are adjusted, it is connected through pipeline P6 to the hydrogen pre-heating system 8. After the hydrogen is heated to the set temperature, it is transported through pipeline P7 to the tuyere of the blast furnace body 1 or the hydrogen injection device at the lower part of the furnace shaft. The gas outlet of the oxygen gas storage tank 4 is connected via pipeline P8 to the oxygen injection valve group 9. After the pressure and flow of the oxygen are adjusted, it is connected through pipeline P9 to the cold air main pipe of the blast furnace body 1. The control signals of the economic hydrogen-injection quantity calculation and control system are connected through signal transmission lines to the electrolyzed water system 2, the hydrogen injection valve group 7, and the oxygen injection valve group 9.

The specific implementation steps include:

Step 1: After the blast furnace being operating smoothly, starting the water-electrolysis hydrogen-production equipment. From 8:00 to 18:00, it being powered by the electricity produced by photovoltaic solar panels, and for the rest of the time, it being powered by off-peak electricity from the power grid or wind energy to produce hydrogen and oxygen and inject them into the blast furnace. The injection volume starting from zero and increasing step by step, with an adjustment step of 25 $Nm^3$/t of iron. At the same time, the existing operating process parameters of the blast furnace needing to be adjusted. On the premise of ensuring the smooth operation of the blast furnace, the qualification of product quality, and the safe operation of equipment, the maximum carbon reduction and optimal economic benefits being achieved. The blast furnace operation time for each adjustment step of the hydrogen injection volume being 15 days, and the maximum hydrogen injection volume being set to 250 $Nm^3/t$ of iron.

Step 2: After 150 days of hydrogen injection operation in the blast furnace, recording the optimal operating parameters and their corresponding operation parameters (including but not limited to hydrogen injection volume, oxygen enrichment rate, coal ratio, blast volume, charging systems of coke and iron-containing materials, etc.) under different hydrogen injection volumes, and establishing a database of operating parameters for the hydrogen-rich blast furnace.

Step 3: Inputting the real-time fluctuating prices of raw materials and fuels, hydrogen price, carbon emission tax, and product price into the economic hydrogen-injection quantity calculation model. Through the calculation formula for the economic benefit of hydrogen injection, obtaining the benefit per ton of iron corresponding to different hydrogen-injection quantities in the current market. By comparison, obtaining the hydrogen-injection quantity that maximizes the benefit per ton of iron, which is the economic hydrogen-injection quantity. Synchronously adjusting the hydrogen-production power of the water-electrolysis hydrogen-production system and the hydrogen-injection quantity into the blast furnace.

The calculation formula for the economic benefit of hydrogen injection is as follows:

$$B = \frac{M_0 - M}{1000} \times P_M + \frac{K_0 - K}{1000} \times P_K + \frac{\eta V_{BF} - \eta_0 V_{BF}}{\eta V_{BF}} \times P_{PI} + (C_0 - C) \times P_{CO_2} + (E_0 - E) - H \times P_{H_2}$$

In the formula:

B: The benefit per ton of iron after hydrogen injection into the blast furnace under the current market conditions, with the unit of yuan per ton of iron (yuan/t);

$M_0$: The coal ratio without hydrogen injection, with the unit of kilograms per ton of iron (kg/t);

M: The coal ratio with hydrogen injection, with the unit of kilograms per ton of iron (kg/t);

$P_m$: The price of the injected pulverized coal, with the unit of yuan per ton of iron (yuan/t);

$K_0$: The coke ratio without hydrogen injection, with the unit of kilograms per ton of iron (kg/t);

K: The coke ratio with hydrogen injection, with the unit of kilograms per ton of iron (kg/t);

$P_k$: The price of the charged coke, with the unit of yuan per ton of iron (yuan/t);

$\eta_0$: The utilization coefficient of the blast furnace without hydrogen injection, with the unit of tons per cubic meter per day [$t/(m^3 \cdot d)$];

$\eta$: The utilization coefficient of the blast furnace with hydrogen injection, with the unit of tons per cubic meter per day [$t/(m^3 \cdot d)$];

VBF: The effective volume of the blast furnace, with the unit of cubic meters ($m^3$);

PPI: The profit per ton of iron, with the unit of yuan per ton (yuan/t);

$C_0$: The direct $CO_2$ emission without hydrogen injection, with the unit of tons per ton of iron (t/t);

C: The direct $CO_2$ emission with hydrogen injection, with the unit of tons per ton of iron (t/t);

$PCO_2$: The carbon-emission trading price, with the unit of yuan per ton of iron (yuan/t);

$E_0$: The operating cost of environmental protection facilities per ton of iron without hydrogen injection, with the unit of yuan per ton of iron (yuan/t);

E: The operating cost of environmental protection facilities per ton of iron with hydrogen injection, with the unit of yuan per ton of iron (yuan/t);

$P_{h^2}$: The production price of hydrogen, with the unit of yuan per standard cubic meter (yuan/$Nm^3$);

H: The hydrogen injection volume, with the unit of standard cubic meters per ton of iron ($Nm^3/t$).

Preferred embodiments of the present invention are described in detail above. It should be understood that many modifications and variations can be made to the concepts of the present invention without creative efforts by those of ordinary skill in the art. Therefore, it would be obvious to a person skilled in the art to arrive at the technical solutions of the present invention by means of logical analysis, reasoning, or limited experiments on the basis of the prior art, all within the scope of protection defined by the claims.

The invention claimed is:

1. A production control method for a hydrogen-rich blast furnace ironmaking system based on energy-mass conversion, the hydrogen-rich blast furnace ironmaking system including a blast furnace and an electrolyzed water system; the electrolyzed water system being respectively connected to a hydrogen gas storage tank and an oxygen gas storage tank; a gas outlet of the hydrogen gas storage tank being connected to a hydrogen compressor; an outlet of the hydrogen compressor being connected to a hydrogen buffer tank; the hydrogen buffer tank being connected to a hydrogen injection valve group; the hydrogen injection valve group being connected to a hydrogen pre-heating system; the hydrogen pre-heating system being connected to a tuyere of the blast furnace or a hydrogen injection device at a lower part of the blast furnace; a gas outlet of the oxygen gas storage tank being connected to an oxygen injection valve group, and the oxygen injection valve group being connected to a cold air main pipe of the blast furnace; the system also including a hydrogen injection quantity calculation and control system, and control signals of the hydrogen injection quantity calculation and control system being connected to the electrolyzed water system, the hydrogen injection valve group, and the oxygen injection valve group through signal transmission lines;

the production control method comprising the steps of:

starting the electrolyzed water system to transport hydrogen and oxygen obtained after electrolysis to the hydrogen gas storage tank and the oxygen gas storage tank, respectively;

pressuring the hydrogen in the hydrogen gas storage tank with the hydrogen compressor and then letting the pressured hydrogen into the hydrogen buffer tank;

after adjusting pressure and flow with the hydrogen injection valve group, pre-heating the hydrogen in the hydrogen pre-heating system;

injecting the pre-heated hydrogen into the blast furnace through the hydrogen injection device; and after the hydrogen injection quantity calculation and control system implements a calculation formula for the economic benefit of hydrogen injection to determine the hydrogen injection quantity that maximizes the current benefit per ton of iron, synchronously controlling the hydrogen production power of the electrolyzed water system and the hydrogen injection quantity into the blast furnace through control signals;

wherein the calculation formula for the economic benefit of hydrogen injection is as follows:

$$B = \frac{M_0 - M}{1000} \times P_M + \frac{K_0 - K}{1000} \times P_K + \frac{\eta V_{BF} - \eta_0 V_{BF}}{\eta V_{BF}} \times P_{PI} + (C_0 - C) \times P_{CO_2} + (E_0 - E) - H \times P_{H_2};$$

in the formula:

B: the benefit per ton of iron after hydrogen injection into the blast furnace under the current market conditions, with the unit of yuan per ton of iron (yuan/t);

$M_0$: the coal ratio without hydrogen injection, with the unit of kilograms per ton of iron (kg/t);

M: the coal ratio with hydrogen injection, with the unit of kilograms per ton of iron (kg/t);

$P_m$: the price of the injected pulverized coal, with the unit of yuan per ton of iron (yuan/t);

$K_0$: the coke ratio without hydrogen injection, with the unit of kilograms per ton of iron (kg/t);

K: the coke ratio with hydrogen injection, with the unit of kilograms per ton of iron (kg/t);

$P_k$: the price of the charged coke, with the unit of yuan per ton of iron (yuan/t);

$\eta_0$: the utilization coefficient of the blast furnace without hydrogen injection, with the unit of tons per cubic meter per day [t/(m$^3$·d)];

$\eta$: the utilization coefficient of the blast furnace with hydrogen injection, with the unit of tons per cubic meter per day [t/(m$^3$·d)];

VBF: the effective volume of the blast furnace, with the unit of cubic meters (m$^3$);

PPI: the profit per ton of iron, with the unit of yuan per ton (yuan/t);

$C_0$: the direct $CO_2$ emission without hydrogen injection, with the unit of tons per ton of iron (t/t);

C: the direct $CO_2$ emission with hydrogen injection, with the unit of tons per ton of iron (t/t);

$PCO_2$: the carbon-emission trading price, with the unit of yuan per ton of iron (yuan/t);

$E_0$: the operating cost of environmental protection facilities per ton of iron without hydrogen injection, with the unit of yuan per ton of iron (yuan/t);

E: the operating cost of environmental protection facilities per ton of iron with hydrogen injection, with the unit of yuan per ton of iron (yuan/t);

$P_{h^2}$: the production price of hydrogen, with the unit of yuan per standard cubic meter (yuan/Nm$^3$);

H: the hydrogen injection volume, with the unit of standard cubic meters per ton of iron (Nm$^3$/t).

2. The production control method according to claim 1, further comprising the step of: after adjusting the pressure and flow rate of the oxygen in the oxygen storage tank by the oxygen injection valve group, injecting the oxygen into the blast furnace through the cold air main pipe.

3. The production control method according to claim 1, wherein the electrolyzed water system is powered by electricity generated by photovoltaic solar panels, off-peak electricity from a power grid, or wind energy.

* * * * *